United States Patent [19]

Wightman

[11] Patent Number: 4,641,708

[45] Date of Patent: Feb. 10, 1987

[54] CASING HANGER LOCKING DEVICE

[75] Inventor: William D. Wightman, Houston, Tex.

[73] Assignee: Hughes Tool Company, Houston, Tex.

[21] Appl. No.: 773,397

[22] Filed: Sep. 6, 1985

[51] Int. Cl.[4] ..... E21B 43/10

[52] U.S. Cl. ..... 166/208; 166/217; 285/141

[58] Field of Search ..... 166/208, 217; 285/3, 285/4, 141, 340

[56] References Cited

U.S. PATENT DOCUMENTS

| | | | |
|---|---|---|---|
| 2,887,163 | 5/1959 | McGowen, Jr. et al. | 166/217 |
| 3,507,329 | 4/1970 | Stone, Jr. | 166/217 |
| 3,721,292 | 3/1973 | Ahlstone | 166/208 |
| 3,736,984 | 6/1973 | Garrett | 166/208 |
| 3,893,717 | 7/1975 | Nelson | 166/217 |
| 3,918,747 | 11/1975 | Putch | 166/208 |
| 4,181,331 | 1/1980 | Cowan | 166/217 |
| 4,402,773 | 9/1983 | Morrill | 285/340 |
| 4,469,172 | 9/1984 | Clark | 166/115 |

OTHER PUBLICATIONS

SG Wellhead Systems Metal-to-Metal Casing Annulus Seal.

The McEvoy "Z-1" Wellhead System.

*Primary Examiner*—Stephen J. Novosad

*Assistant Examiner*—William P. Neuder

*Attorney, Agent, or Firm*—James E. Bradley

[57] ABSTRACT

A subsea well assembly has a casing hanger that lands inside the wellhead with a locking device to lock the hanger in the wellhead. The locking device includes a collar mounted to the hanger body and movable relative to the body between a lower storage position and an upper set position. The collar contacts a landing shoulder located in the wellhead to move to the set position. Washers located between the collar and the hanger body allow the hanger body to move downward when the collar contacts the landing shoulder. The washers deflect downwardly due to interference fit when the hanger moves to the set position to resist upward movement. As the hanger body moves downward, a split ring is pushed outwardly by inclined surfaces to engage locking grooves formed in the interior of the wellhead for supporting the casing hanger.

4 Claims, 6 Drawing Figures

CASING HANGER LOCKING DEVICE

CROSS-REFERENCE TO RELATED APPLICATION

This application is being filed simultaneously with an application diclosing common subject matter entitled "METAL CASING HANGER SEAL WITH EXPANSION SLOTS", inventor Carl F. Boehm, Jr.

BACKGROUND OF THE INVENTION

1. Field of the Invention

This invention relates in general to subsea wellhead equipment, and in particular to a casing or tubing hanger having a metal-to-metal seal.

2. Description of the Prior Art

A typical subsea wellhead assembly includes a wellhead housing mounted within a permanent guide base that is supported on the ocean floor by a temporary guide base. Large diameter conductor pipe is secured to the wellhead housing and extends downward into the earth a short distance. A wellhead is mounted inside the wellhead housing and to a permanent guide base which mounts on the top of the temporary guide base. Surface casing secured to the wellhead extends a few hundred feet down into the well. The top of the wellhead is connected to pressure equipment and risers that extend to a drilling vessel at the surface. As the well is drilled deeper, a first string of casing may be set to a certain depth. Subsequently, a second string of casing may be set.

In a typical installation, the casing hanger includes a casing hanger body which is secured to the upper end of the casing string. The body is supported on an annular shoulder in the wellhead. A seal and a locking means are located in annular clearances between the casing hanger body and wellhead bore. The seal normally includes an elastomeric ring which is compressed by compression rings between the casing hanger body and the wellhead bore. The locking means includes a split ring and/or various wedges, which are normally actuated by rotation of a running tool to lock the elastomeric seal in compression and to lock the casing hanger in the wellhead. Wickers, which are small parallel grooves, may be located in the wellhead bore for engagement by the split ring or wedges. The locking means provides support for the casing hanger.

It is important to be assured that the locking means has properly landed on the landing shoulder and actuated. In one prior art technique, spring clips are used to retain the locking means in place prior to actuation. This requires boring holes through the wellhead, which is a disadvantage. Also, if the casing hanger is later pulled and another ran, the spring clips could not be used again.

SUMMARY OF THE INVENTION

The locking assembly of this invention has a collar mounted to the hanger body that engages the landing shoulder in the wellhead. The hanger body moves downwardly relative to the collar. Washers located between the collar and hanger body allow the downward movement, but deflect to resist upward movement. The downward movement pushes a split ring outwardly into locking engagement with grooves formed in the wellhead bore.

DESCRIPTION OF THE PREFERRED EMBODIMENT

Figure 1:
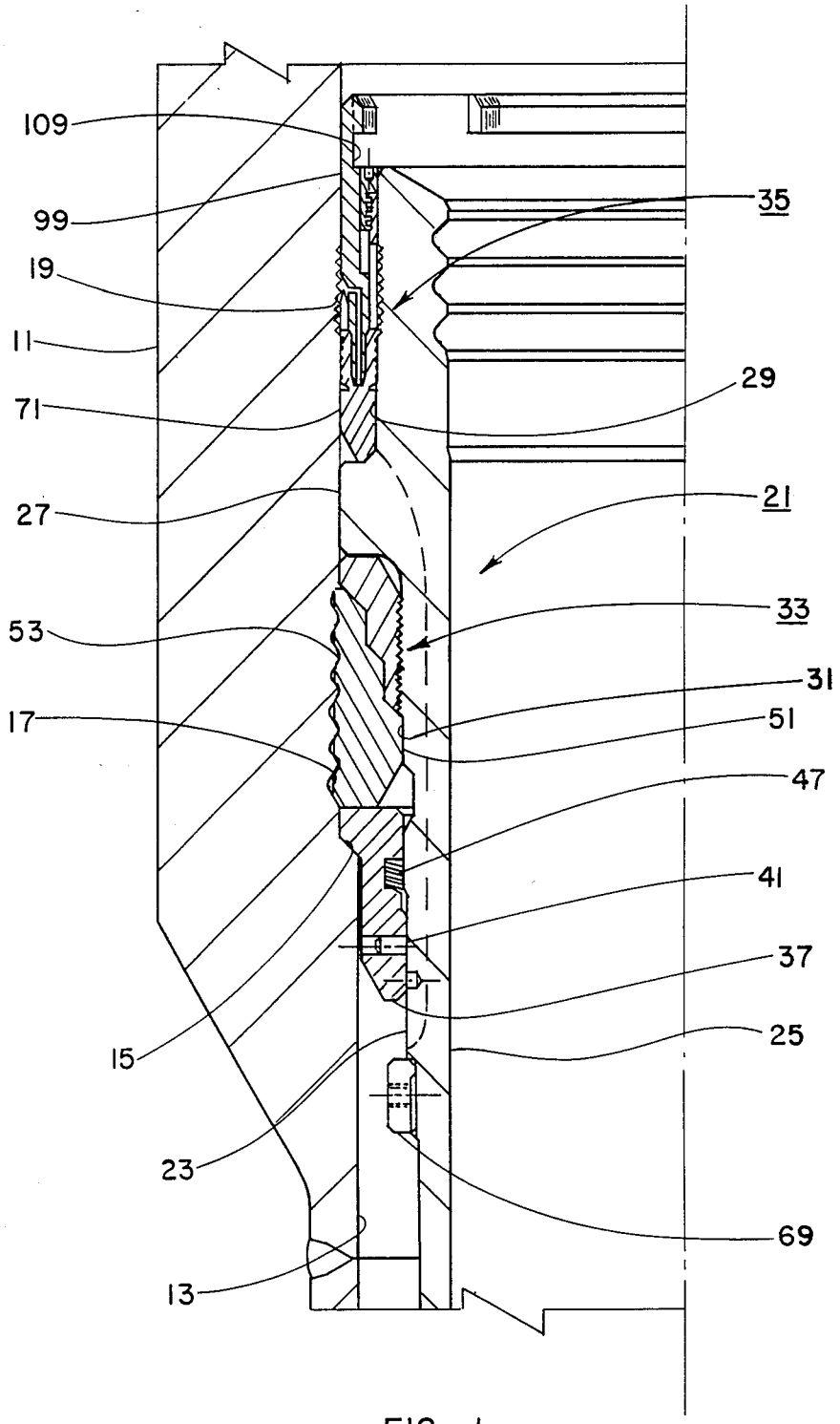
FIG. 1 is a partical vertical sectional view of a wellhead having a seal constructed in accordance with this invention, and also is showing a locking means for locking the casing hanger in place.

The subsea well assembly shown in FIG. 1 includes a wellhead 11. Wellhead 11 is a tubular member located at the sea floor at the top of the well. Wellhead 11 has a bore 13 that contains an upwardly facing landing shoulder 15. Landing shoulder 15 is inclined downwardly. A plurality of locking grooves 17 are located a short distance above the landing shoulder 15 in the bore 13. The locking grooves 17 are approximately ¼ inch deep in the preferred embodiment, and the centers of each groove are about one inch apart. Locking grooves 17 are circumferential, parallel to each other and have rounded edges.

A plurality of wickers 19 are located in a set spaced above the locking grooves 17. The wickers 19 are much smaller grooves. They are parallel, circular, and formed perpendicular to the axis of bore 13. Preferably there are about eight grooves of wickers 19 per inch. Wickers 19 are generally triangular in cross-section.

A casing hanger 21 is secured to a string of casing (not shown) and lowered into a landing position in the wellhead 11. Often there will be more than one casing hanger 21, each secured to a string of casing of smaller diameter than the casing supported by the casing hanger immediately below. Casing hanger 21 has a body 23 that has an axial bore or passage 25. Body 23 is a tubular member with an outer diameter smaller in diameter than the wellhead bore 13, except for an annular band 27 located intermediate the ends of casing hanger 21. Band 27 closely fits within the bore 13. This results in an upper annular clearance 29 above band 27 and between the casing hanger body 23 and wellhead 11, and a lower annular clearance 31 located below annular band 27. A lock assembly 33 is located in the lower clearance 31 for locking the casing hanger 21 to the wellhead 11. A seal assembly 35 is located in the upper clearance 29 for sealing the casing hanger 21 to the wellhead 11.

Figure 5:
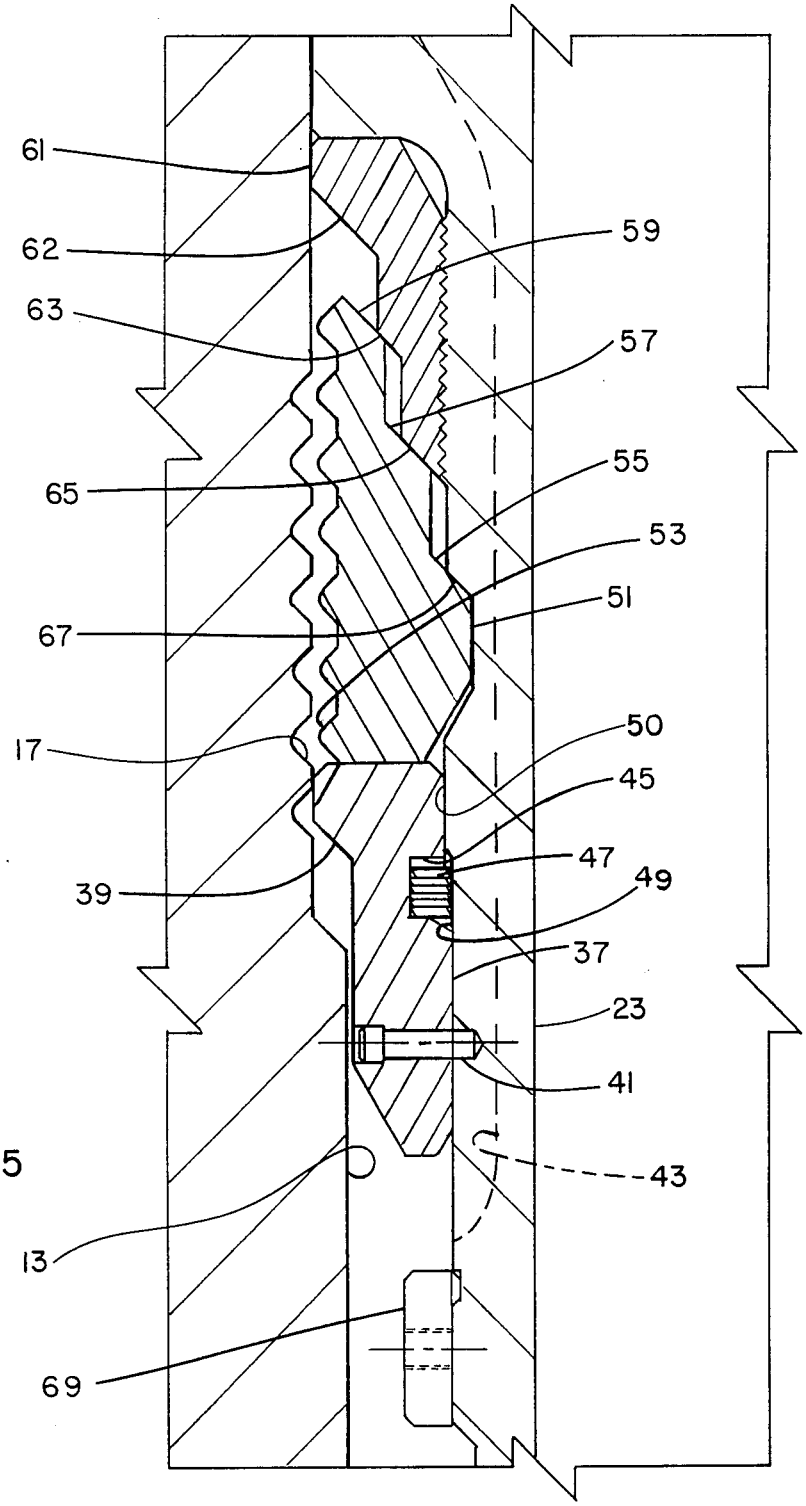
FIG. 5 is an enlarged vertical sectional view of the locking and supporting means for the casing hanger of FIG. 1, shown in a storage position prior to locking engagement.

Referring to FIG. 5, the lock assembly 33 includes a collar 37 on the lower end. Collar 37 has an upper flange 39 with a downwardly facing surface that is adapted to mate with and engage the landing shoulder 15 in the wellhead bore 13. A shear pin 41 releasably secures the collar 37 to the casing hanger body 23. When flange 39 contacts the landing shoulder 15, and weight is applied, the shear pin 41 will shear, allowing the hanger body 23 to move downwardly a short distance. A plurality of vertical flutes 43 extend up the hanger body for allowing return flow during cementing of the casing string.

Figure 6:
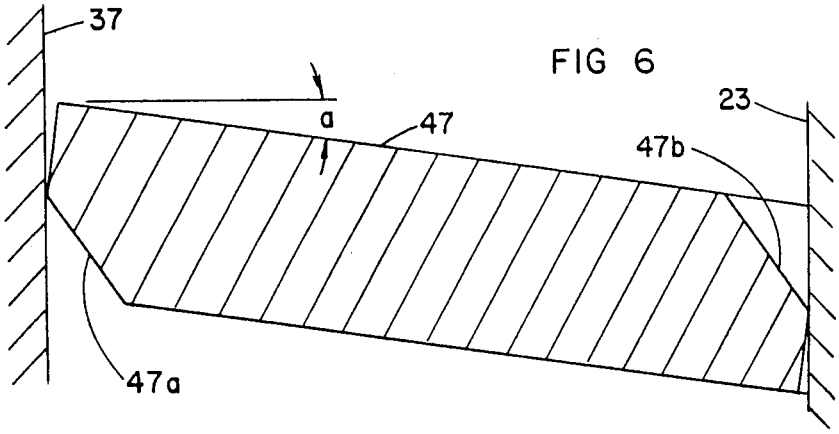
FIG. 6 is a further enlarged vertical sectional view of one of the washers of the locking and supporting means, shown in a set position.

Collar 37 has an interior annular recess 45. Recess 45 is adapted to receive a plurality of washers. Washers 47 are flat steel members, having a hardness of about 60 Rockwell B, which is not as hard as collar 37 or hanger body 23. Each washer 47 is split. The outer diameters of the washers 47 engage the inner wall of recess 45 in a snug fit. The inner diameter of each washer 47 will be located adjacent to a reduced diameter portion 49 formed on the hanger body 23, and will not contact the portion 49. When collar 37 lands on shoulder 15, and hanger body 23 moves downwardly relative to collar 37, the washers 47 will contact an enlarged diameter portion 50 of hanger body 23, which is located above the reduced diameter portion 49 and slightly greater in diameter. The enlarged diameter portion 50 has a diameter that is about 0.016 inch greater than the inner diameter of each washer 47. This causes the washers 47 to deflect downward into a locking position as shown in FIG. 6. The washers 47 undergo permanent deformation beyond their yield strengths when deflected. In the locking position, the hanger body 23 cannot be readily pulled upward relative to the collar 37.

In the locking position, the flat surfaces of the washers 47 incline at an angle a from 5° to 15°, preferably about 10°, with respect to a line perpendicular to the axis of hanger body 23. A 45° bevelled surface 47*a* is located on the outer lower edge of each washer 47. A 45° bevelled surface 47*b* is located on the inner upper edge of each washer 47. This results in better surface contact between the washers 47 and the collar 37 and hanger body 23 when in the set position.

A split ring 51 has its lower end in contact with the collar 37. Split ring 51 comprises an expansible annular ring spaced around the hanger body 23. The split ring 51 has a plurality of grooves 53 located on the exterior. Grooves 53 have the same dimension as the locking grooves 17 in the wellhead bore 13. Split ring 51 has three inclined reacting surfaces 55, 57, and 59 located on the interior.

An upper load ring 61 is secured by threads on its interior to the hanger body 23. Upper ring 61 has an outwardly extending flange 62 with an inclined lower surface. Upper ring 61 also has two cam surfaces 63 and 65 which are inclined at the same angle to mate with the reacting surfaces 57 and 59 of the split ring 51. The hanger body 23 also has a cam surface 67 which is inclined at the same angle as reacting surface 55. When collar 37 lands on the landing shoulder 15 and the hanger body 23 continues downward movement, the split ring 51 will not be able to move downward along with body 23 due to its contact with the collar 37. The reacting surfaces 55, 57, and 59 act against the cam surfaces 63, 65, and 67 to result in a radial outward movement. Grooves 53 will engage the locking grooves 17 to lock the casing hanger 21 in place and provide support. Downward force on casing hanger 23 is transmitted through split ring 51 to the grooves 17 and wellhead 11. The locked position is shown in FIG. 1.

A retaining ring 69 is located below the collar 37 for retaining the collar 37 and split ring 51 should the casing hanger 21 later be withdrawn to the surface. To withdraw the casing hanger 21, a force sufficient to overcome the resistance of the washers 47 must be exerted. Preferably this force is around 200,000 pounds.

Figure 2:
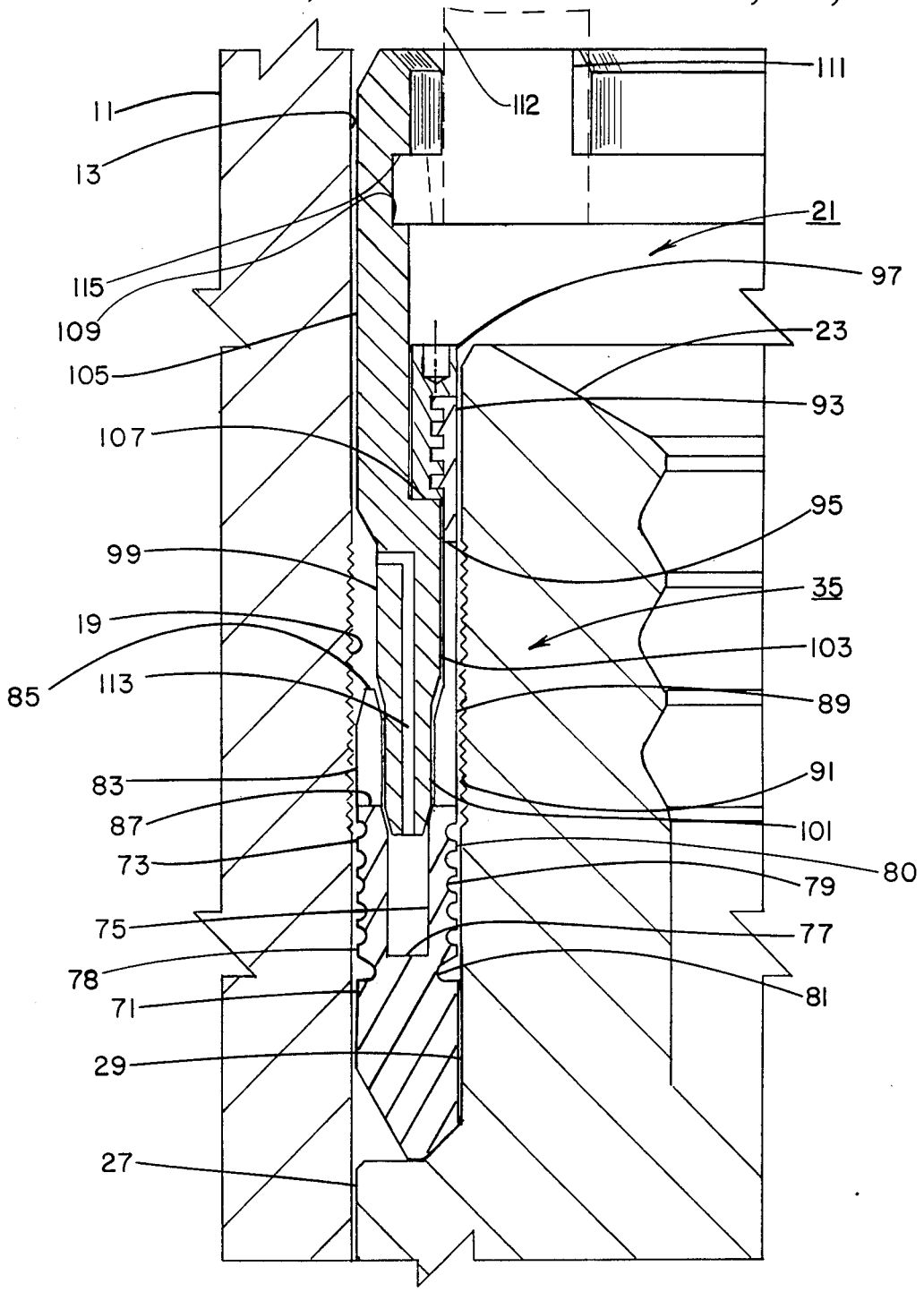
FIG. 2 is an enlarged sectional view of the seal of FIG. 1, shown in the disengaged position.

Referring to FIG. 2, the seal assembly 35 has a metal seal ring 71. Seal ring 71 has an outer annular wall 73 that is spaced radially outward from an inner annular wall 75. This results in an annular cavity 77 located between the walls 73 and 75. A plurality of grooves 79 are located in a seal section 78 of the walls 73 and 75. The grooves 79 on inner wall 75 face inwardly for engaging hanger body 23. The grooves 79 on the outer wall 73 face outwardly for engaging the bore 13 of wellhead 11. Grooves 79 are circumferential grooves parallel to each other. They are larger than the wickers 19 in the wellhead bore 13 and smaller than the locking grooves 17 in the wellhead bore 13. Preferably each groove 79 has a depth of about ⅛ inch, and its cetnerline is spaced from the centerlines of adjacent grooves by about ¼ inch. The grooves 79 are rounded, and cylindrical sealing surfaces 80 are located between each groove 79 for sealing contact with the wellhead bore 13 or the hanger body 23. Each sealing surface 80 has a longitudinal height or dimension that is from 1/16 to 3/32 inch. There is a lower groove 81 on each wall 73 and 75 which has a greater depth than the grooves 79. The lower groove 81 is located adjacent the bottom of the cavity 77 between the walls 73 and 75. Prior to energizing, the radial dimension from the sealing surfaces 80 of grooves 79 on inner wall 75 to the seling surfaces on outer wall 73 is preferably about 0.030 inch less than the width of upper clearance 29.

Figure 3:
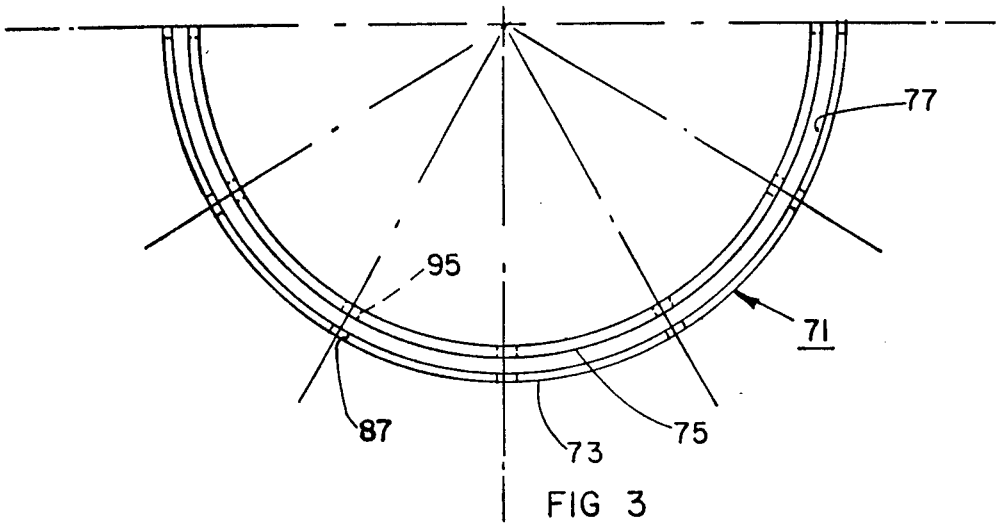
FIG. 3 is a top partial view of the seal ring for the seal of FIG. 1.

A gripping section 83 is located above the seal section on outer wall 73. The gripping section 83 does not contain any grooves 79, and it terminates in a rim 85 on outer wall 73. A plurality of vertical slots 87 extend through the outer wall 73 in the gripping section 83, as shown more clearly in FIGS. 3 and 4. Gripping section 83 aligns with wickers 19 in wellhead 111.

Figure 4:
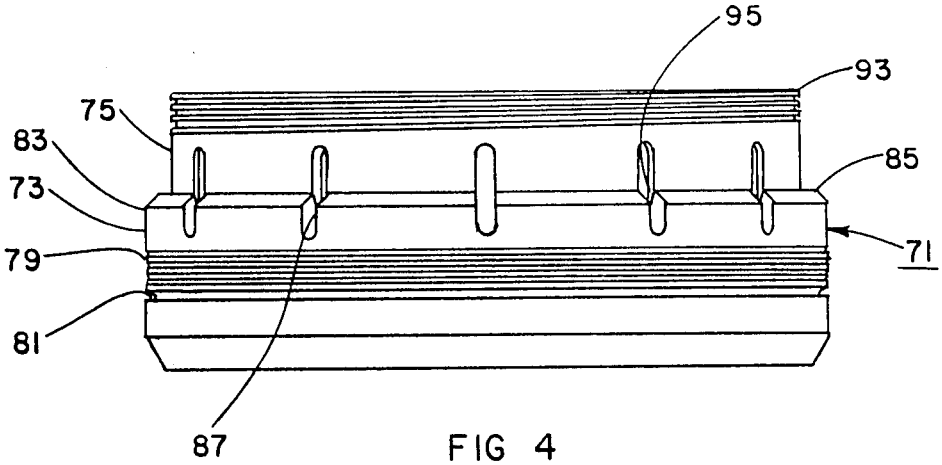
FIG. 4 is a side view of a seal ring shown in FIG. 3.

There is a gripping section 89 also on the inner wall 75 located radially inward from the gripping section 83. Gripping section 89 is located above the grooves 79 and adapted to align with a set of wickers 91 formed on the exterior of the hanger body 23. Wickers 91 are located adjacent the wickers 19 in the wellhead bore 13 when the casing hanger 21 is landed in the wellhead 11. The gripping section 89 is located below the rim 93 of the inner wall 75, which is threaded. A plurality of vertical slots 95 extend through the gripping section in radial alignment with the slots 87. slots 95, however, do not extend to the top of the rim 93, rather terminate a selected distance below as shown in FIG. 4. A retaining ring 97 is secured to the threads of the rim 93 and located on the exterior of the inner wall 75. The inner wall 75 extends above the outer wall 73 a considerable distance An energizing ring 99 is carried with the seal ring 71. Energizing ring 99 has a lower section 101 that is adapted to be forced into the cavity 77. Prior to actuating the seal ring 71, as shown in FIG. 2, the energizing ring 99 is located with its lower section 101 at the entrance of the cavity 77. The lower section 101 is greater in radial thickness than the cavity 77 by at least 0.030 inch, so as to wedge tightly therein and force the inner and outer walls 73 and 75 outward into sealing engagement with the hanger body 23 and the wellhead bore 13. The energizing ring 99 also has a middle section 103 which is of greater radial thickness than the lower section 101 and the cavity 77 between gripping sections 83 and 89. The middle section 103 when in the engaged position as shown in FIG. 1, locates in the upper portion of cavity 77 between the slotted or gripping sections 83 and 89. A tapered area exists between the lower section 101 and middle section 103. Energizing ring 99 also has an upper section 105 that extends above the retaining ring 97 while in the disengaged position. A shoulder 107 is located generally at the junction of the middle section 103 and the upper section 105. Shoulder 107 is located on the interior to contact the lower side of the retaining ring 97 if the seal assembly is being withdrawn.

Energizing ring 99 has a circumferential recess 109 formed in the interior of the upper section 105. Vertical channels 111 extend downwardly in the interior of ring 99 from the upper edge of ring 99 to recess 109. Recess 105 is adapted to be engaged by handling tools with members that enter through slots 11. Rotating the handling tool after the members reach recess 105 will secure the energizing ring 99 to the handling tool. A handling or setting tool shown schematically with dotted lines 112 will extend through channels 111 and contact the upper edge of recess 109 to move downwardly. A different handling tool (not shown) will be used to release energizing ring 99 by moving it upwardly. It will contact a dowardly facing shoulder 115 in recess 109 to move energizing ring 99 upwardly. A passage 113 extends through the lower section 101 to allow liquids contained in the cavity 77 to be purged as the energizing ring 99 enters the cavity 77.

The seal ring 71 is constructed of a mild steel which has a hardness less than about 150 BHN. The material should preferably have a hardness 40–50 BHN less than the hardness of wellhead 11 and hanger body 23. This material is sufficiently soft to permanently deform and seal against the hanger body 23 and the wellhead bore 13.

In operation, the lock assembly 33 will be secured to the hanger body 23 by the shear pin 41. The hanger body 23 will be secured to the upper end of the string of casing (not shown) as it is being lowered into the well. When the flange 39 contacts the landing shoulder 15 (FIG. 5), pin 41 will shear, and hanger body 23 will move downwardly relative to the collar 37 and the split ring 51. The washers 47 deflect downwardly because of the interference fit of the washers 47 between the hanger body 23 and the recess 4534 that occurs when the hanger body 23 moves downwardly. The washers 47 serve as wedge means to allow downward movement of the hanger body 23 relative to the collar 37, but to resist any upward movement.

As the hanger body 23 moves downwardly, the cam surfaces 63, 65, and 67, serve as cam means to act against the reacting surfaces 55, 57, and 59 to urge the split ring 51 out into engagement with the grooves 17. The upper end of the split ring 61 will contact flange 62 of the upper ring 61. This will stop downward movement of the hanger body 23. The landing of the casing hanger 21 can be checked by pulling upwardly on the hanger body 23. If the washers 47 resist the upward movement, this indicates that the pin 41 has sheared properly and that the casing hanger 21 is properly locked in place. The split ring 51 will transmit forces on the hanger body 23 to the wellhead 11. Cement can then be pumped down through the casing hanger 21 and string to cement the string in place, with returns flowing through the flutes 43 to the surface.

After the cement has set, the seal assembly 35 can be lowered in place with the setting tool 112. The energizing ring 99 will be secured to the setting tool 112 by shear pins (not shown). The energizing ring 99 will be in the position shown in FIG. 2 while the setting tool 112 lowers the seal assembly 35 into the annular clearance 29. When in place, further downward movement of the setting tool 112 causes the energizing ring 99 to move downwardly. The lower and middle sections 101 and 103 spread the walls 73 and 75 apart. The seal sections 78 seal tightly against the hanger body 23 and the wellhead bore 13. The slotted or gripping sections 83 and 89 are pressed tightly against the wickers 19 and 91 to retain the seal ring 71 in place. The setting tool 112 can then be removed and withdrawn to the surface. The gripping sections 83 and 89 resist upward force tending to push the seal assembly 35 upwardly due to pressure To release the seal assembly 35, a handling tool (not shown) is lowered into engagement with the recess 109 and rotated to the right 45° to engage the upper shoulder 114 for release. The handling tool is picked up, causing the shoulder 107 of energizing ring 99 to move up into contact with the retaining ring 97. The entire seal assembly 35 may be withdrawn.

To remove the casing hanger 21, a handling tool must grip the casing hanger 21 and pull it upwardly sufficiently to deform the washers 47. The upward movement allows the split ring 51 to disengage from the grooves 17, allowing the casing hanger 21 to be pulled upwardly.

The invention has significant advantages. The locking device locks the hanger body to the collar when the split ring engages the locking grooves in the wellhead. This assures that the casing hanger is properly retained. The locking device avoids the need for spring clips mounted to the wellhead, which require holes to be drilled through the wellhead.

While the invention has been shown in only one of its forms, it should be apparent to those skilled in the art that it is not so limited but is susceptible to various changes without departing from the scope of the invention.

I claim:

1. In a well assembly having a wellhead with a bore containing an internal landing shoulder formed therein and a plurality of internal grooves located above the shoulder, a casing hanger having a body adaptged to be mounted to the top of a string of casing, an improved locking and supporting means for securing the casing hanger in the wellhead, comprising in combination:

a collar slidably mounted to the exterior of the body, the collar protruding from the body for contacting the landing shoulder as the casing hanger is lowered into the wellhead, the collar being movable relative to the body from a lower storage position to an upper set position which occurs when the collar contacts the landing shoulder and the hanger body continues downward movement;

wedge means located between the collar and the body for allowing downward movement of the hanger body when the collar contacts the landing shoulder, but resisting upward movement of the hanger body relative to the collar;

a split ring slidably carried by the hanger body with its lower edge in contact with the collar, having grooves on its exterior adapted to mate with the grooves in the wellhead; and cam means for pushing the split ring outwardly into engagement with wellhead grooves to lock the hanger in the wellhead when the collar contacts the landing shoulder and the hanger body continues downward movement, to move the collar from the storage to the set position.

2. In a well assembly having a wellhead with a bore containing an internal landing shoulder formed therein and a plurality of interior grooves located above the shoulder, a casing hanger having a body adapted to be mounted to the top of the string of casing, an improved locking and supporting means for securing the casing in the wellhead, comprising in combination:

a collar having a contacting surface for contacting the landing shoulder;

means for mounting the collar to the exterior of the body for movement relative to the body from a lower storage position to an upper set position when the collar contacts the landing shoulder and the hanger body continues downward movement;

at least one split washer surrounding the hanger body, with its inner diameter in contact with the hanger body and its outer diameter in contact with the collar;

means for mounting the washer to allow downward movement of the hanger body relative to the collar as the collar moves to the set position, and to cause deflection of the washer for resisting upward movement of the hanger body relative to the collar;

a split ring carried by the hanger body with its lower edge in contact with the collar, having grooves on its exterior adapted to mate with the grooves in the wellhead; and cam means for pushing the split ring outwardly into engagement with the wellhead grooves to lock the hanger in the wellhead when the collar contacts the landing shoulder and the hanger body continues downward movement.

3. In a well assembly having a wellhead with a bore containing an internal landing shoulder formed therein and a plurality of interior grooves located above the shoulder, a casing hanger having a body adapted to be mounted to the top of the string of casing, an improved locking and supporting means for securing the casing in the wellhead, comprising in combination:

a collar having flange means for contacting the landing shoulder;

means for mounting the collar to the exterior of the body for movement relative to the body from a lower storage position to an upper set position when the flange means contacts the landing shoulder and the hanger body continues downward movement;

the collar having an interior annular recess;

the hanger body having an enlarged diameter section positioned to align with the annular recess when the collar is in the set position;

a plurality of split washers carried in the annular recess, the washers being dimensioned for interferece fit between the annular recess and the enlarged diameter section, causing the washers to deflect and resist upward movement of the hanger body relative to the collar when in the set position;

shear pin means mounted between the collar and body to retain the body and collar in the storage position until contact with the landing shoulder causes the shear pin means to shear;

a split ring carried by the hanger body with its lower edge in contact with the collar, having grooves on its exterior adapted to mate with the grooves in the wellhead, the split ring having at least one inner inclined surface that slidingly mates with at least one exterior inclined surface provided on the hanger body, to push the split ring outward to lock the hanger in the wellhead when the collar contact the landing shoulder and the hanger body continues downward movement to move the collar to the set position.

4. In a well assembly having a wellhead with a bore containing an internal landing shoulder formed therein and a plurality of interior grooves located above the shoulder, a casing hanger having a body adapted to be mounted to the top of the string of casing, an improved locking and supporting means for securing the casing in the wellhead, comprising in combination:

a collar having a contacting surface for contacting the landing shoulder;

means for mounting the collar to the exterior of the body for movement relative to the body from a lower storage position to an upper set position when the collar contacts the landing shoulder and the hanger body continues downward movemnt;

the collar having an interior annular recess;

the hanger body having an enlarged diameter section positioned to align with the collar when the collar is in the set position;

a plurality of split washers surrounding the hanger body and located within the recess, the transverse dimension of each washer being greater than the radial distance between the enlarged diameter section and recess to cause the washers to deflect downwardly as the collar moves to the set position, the deflection of the washers causing them to resist upward movement of the hanger body relative to the collar when in the set position;

each washer having a bevelled upper edge on its inner diameter, and a bevelled lower edge on its outer diameter;

a split ring carried by the hanger body with its lower edge in contact with the collar, having grooves on its exterior adapted to mate with the grooves in the wellhead; and cam means for pushing the split ring outwardly into engagement with the wellhead grooves to lock the hanger in the wellhead when the collar contacts the landing shoulder and the hanger body continues downward movement.

* * * * *